United States Patent [19]

Bolongeat-Mobleu et al.

[11] Patent Number: 5,003,138

[45] Date of Patent: Mar. 26, 1991

[54] ROTATING ARC ELECTRICAL SWITCH

[75] Inventors: Roger Bolongeat-Mobleu, Echirolles; Denis Raphard, Sassenage; Jean-Pierre Boyer, Voreppe, all of France

[73] Assignee: Merlin Gerin, Meylan, France

[21] Appl. No.: 527,895

[22] Filed: May 24, 1990

[30] Foreign Application Priority Data

May 31, 1989 [FR] France ..... 89 07290

[51] Int. Cl.[5] ..... H01H 33/18

[52] U.S. Cl. ..... 200/147 R; 200/148 B

[58] Field of Search ..... 200/147 C, 147 R, 148 B

[56] References Cited

U.S. PATENT DOCUMENTS 3,763,340 10/1973 Noack ..... 200/148 D
4,488,023 12/1984 Matsumoto et al. ..... 200/147 C
4,743,719 5/1988 Spooner ..... 200/147 C

FOREIGN PATENT DOCUMENTS 0053524 6/1982 European Pat. Off. .
0092205 10/1983 European Pat. Off. .
2493034 4/1982 France .
2103018 2/1983 United Kingdom .

*Primary Examiner*—Robert S. Macon
*Attorney, Agent, or Firm*—Parkhurst, Wendel & Rossi

[57] ABSTRACT

A medium-voltage electrical switch comprises contacts actuated by a connecting rod and crank system. Parallel to the main contacts there is arranged an arcing circuit comprising a cylindrical electrode disposed inside a coil and whose internal surface cooperates with a movable arcing contact. The mechanical link connecting the main contact to the arcing contact comprises a crank and connecting rod system comprising a flexible part formed by an aperture and a spring providing the contact pressure of the arcing contacts. In the open position of the switch, the connecting rod extends perpendicular to the crank and the flexible part is neutralized so as to hold the movable arcing contact without clearance in the open position despite the electrodynamic forces acting on it.

10 Claims, 4 Drawing Sheets

ROTATING ARC ELECTRICAL SWITCH

BACKGROUND OF THE INVENTION

The invention relates to an electrical gas-blast switch by arc rotation due to the action of a magnetic field, having a sealed enclosure filled with a high dielectric strength gas, notably sulphur hexafluoride, in which there are disposed a movable main contact pivotally mounted on a first fixed spindle and operating in conjunction with a stationary main contact and a movable arcing contact pivotally mounted on a second fixed spindle parallel to said first fixed spindle and operating in conjunction with a rotation electrode, disposed coaxially inside a coil, electrically connected in series with the arcing contacts in an arcing circuit connected parallel to the main circuit which comprises said main contacts.

An electrical switch of the kind mentioned uses the energy of the arc to blow out the latter and therefore requires a relatively low operating energy, limited to the mechanical force of moving the contacts. The main contacts are protected by switching to the arcing circuit, this switching being able to be achieved either by arc migration or by arcing contacts connected in parallel with the main contacts and opening after the main contacts have separated. The use of arcing contacts connected in parallel with the main contacts prevents any arc or spark from forming on the latter when they separate, but requires perfect synchronization of the movements in order to avoid any premature opening of the arcing contacts or inversely on closing to prevent the main contacts from closing first. In addition to the problem of synchronization of movements, there also arises that of the electrodynamic repulsion effects exerted on the movable contacts through which the short-circuit currents flow requiring robust operating mechanisms.

The object of the present invention is to achieve a switch with a simplified operating mechanism capable of positioning and operating the main contacts and arcing contacts.

SUMMARY OF THE INVENTION

The switch according to the invention is characterized in that said electrode is in the shape of a hollow cylinder inside which said movable arcing contact moves between two extreme, closed and open positions, in which the movable arcing contact is respectively in contact with the internal periphery of the electrode and appreciably in the center of said electrode, and that a mechanical link connects the movable main contact and the movable arcing contact to cause the arcing contacts to open after the main contacts have opened and the arcing contacts to close before the main contacts close, said mechanical link comprising a flexible part to provide the closing contact pressure of the arcing contacts and a means of neutralizing the flexible part in the central open position of the movable arcing contact to create a rigid link between the two movable contacts, said flexible part allowing a continued closing movement of the movable main contact after the movable arcing contact has moved to the closed position and inversely a prior opening movement of the movable main contact before the movable arcing contact opens.

In the closed position of the switch, the main contacts and arcing contacts are both closed, only a fraction of the current flowing through the arcing circuit which has a high impendance due among things to the blow-out coil inserted in this circuit. The movable arcing contact is held against the cylindrical electrode constituting the stationary arcing contact with sufficient contact pressure generated by the flexible part of the mechanical link.

This flexible contact force prevents any spurious opening of the arcing contacts. This flexible link associated with a dead travel moreover allows delayed opening of the arcing contacts when an opening movement of the main contacts occurs and inversely allows prior closing of the arcing contacts. In the open position the flexible part is neutralized and the movable arcing contact is rigidly coupled to the stationary contact. The movable arcing contact is thus held positively in the open position in the axis of the cylindrical electrode and is capable of resisting the electrodynamic forces exerted on it.

Neutralization of the flexible part in the open position of the switch is achieved by a connecting rod and crank system having an articulation slidingly mounted in an aperture securedly united to the crank. The stationary main contact supports the crank whereas the connecting rod is articulated on the movable arcing contact. The flexible part is formed by a spring urging the trunnion, supported by the connecting rod and forming the articulation of the connecting rod and crank system, to the bottom of the aperture of the crank. In the open position the crank and connecting rod extend perpendicularly and the forces exerted on the connecting rod are transmitted directly to the crank while having no effect on the flexible part. The degree of movement of the crank is close to 90° and the connecting rod and crank system is appreciably aligned in the open position of the switch. The movable main contact is a knife-blade pivotally mounted on a fixed spindle supported by the end of a bushing and this knife-blade operates in conjunction with a stationary contact pad or grip securedly united to another bushing. The movable arcing contact is a contact stud coming into contact with the internal surface of the cylindrical electrode. The assembly is housed in a sealed enclosure filled with sulphur hexafluoride, the arcing circuit being offset with respect to the main circuit which is smaller in length.

The operating mechanism located outside the enclosure drives an operating shaft passing tightly through the wall of the enclosure. This operating shaft bears a crank connected by a connecting rod to the movable main contact. When an opening movement occurs due to the rotation of the operating shaft the movable main contact pivots in the opening direction driving the crank in rotation which by means of the lengthwise aperture introduces a dead travel maintaining the movable arcing contact in the closed position. The main contacts separate before the dead travel has been completed causing the current to be switched to the arcing circuit. This current flowing through the blow-out coil generates a magnetic field, notably an axial field, inside the cylindrical electrode. Continued movement of the movable main contact, when the dead travel has been completed, causes the movable arcing contact to pivot to the central open position with the formation of an arc extending radially inside the cylindrical electrode. This arc is subjected to magnetic blow-out by rotation causing it to be extinguished rapidly.

The movable arcing contact is perfectly positioned in the center of the cylindrical electrode whatever the electrodynamic forces exerted on it.

BRIEF DESCRIPTION OF THE DRAWINGS

Other advantages and features will become more clearly apparent from the following description of an illustrative embodiment of the invention, given as a non-restrictive example only and represented in the accompanying drawings, in which.

DESCRIPTION OF THE PREFERRED EMBODIMENT

Figure 1:
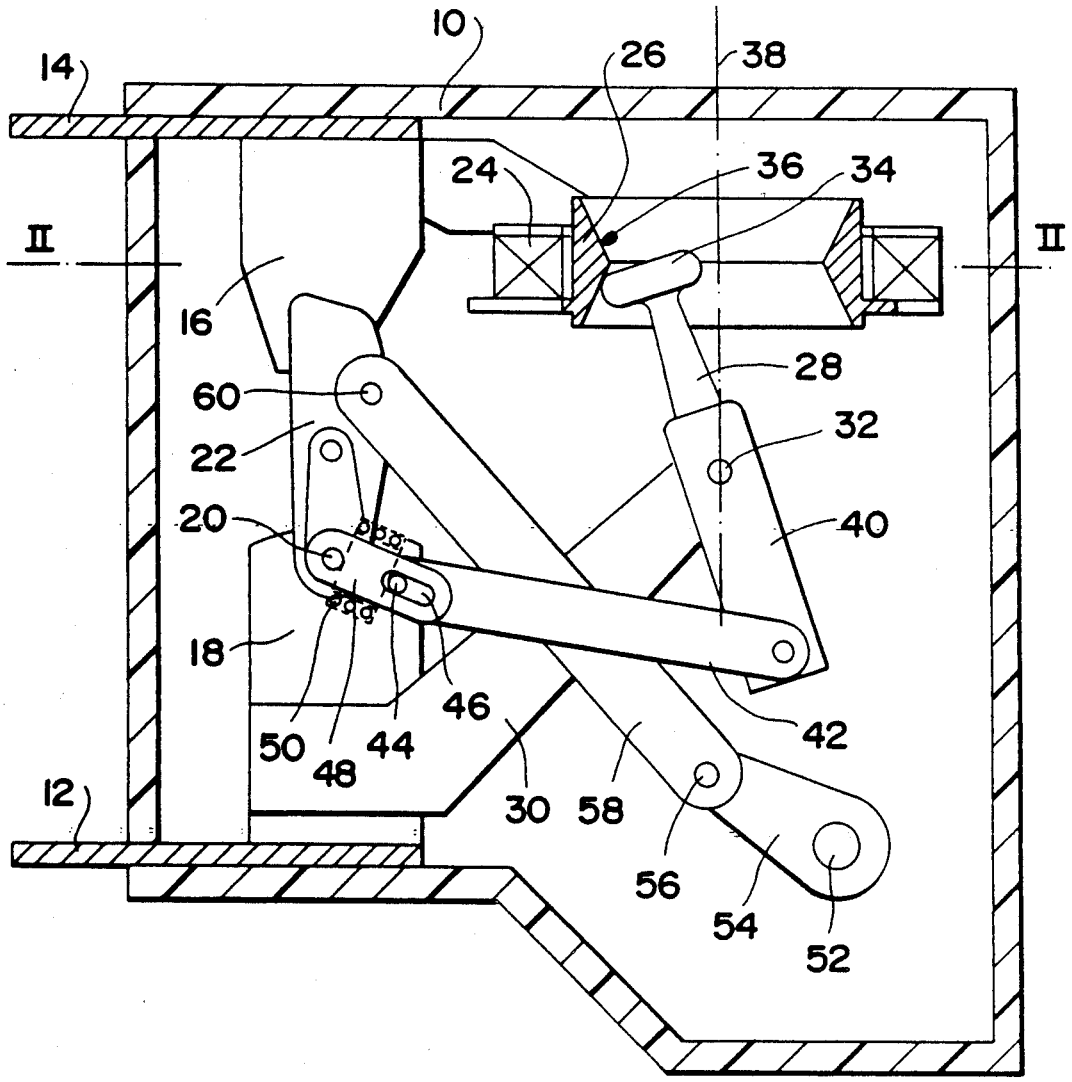
FIG. 1 is a longitudinal cross-section along the line I—I of FIG. 2 of a switch according to the invention represented in the closed position.
Figure 2:
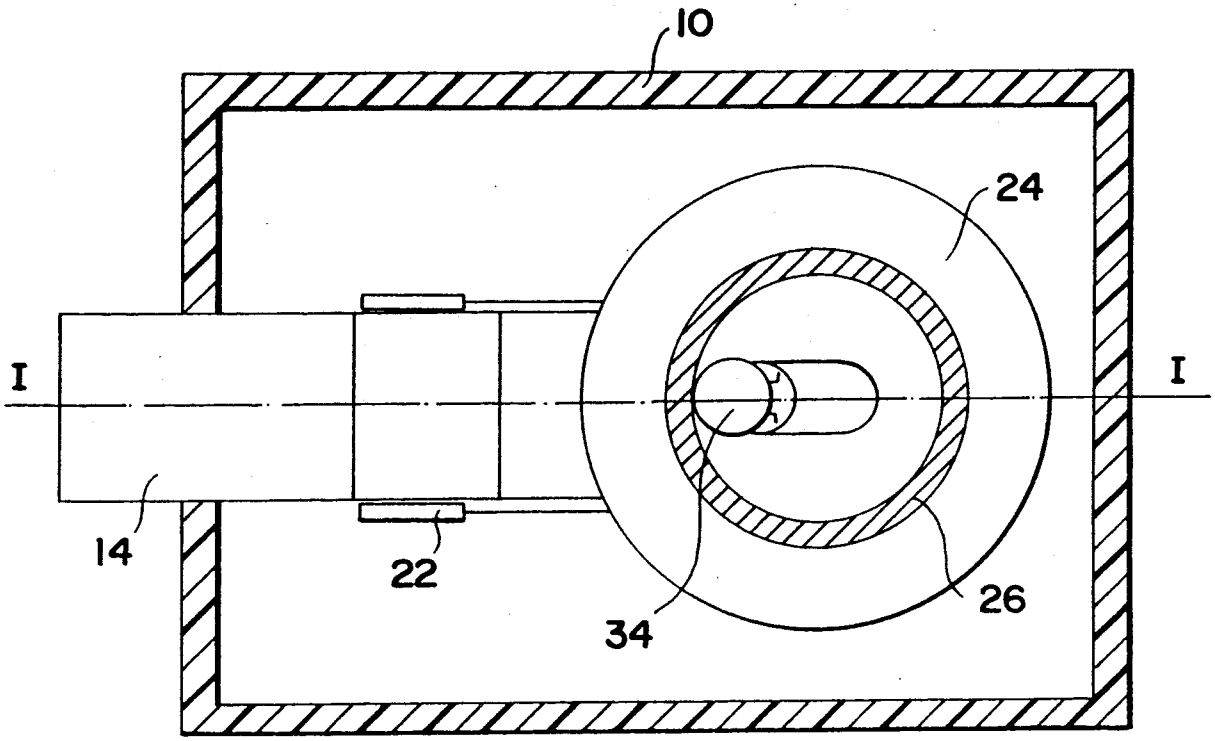
FIG. 2 is a cross-section along the line II—II of FIG. 1.

In the figures, a pole-unit of an electrical circuit breaker, notably a medium-voltage circuit breaker, comprises a sealed enclosure 10 made of insulating material filled with a high dielectric strength gas, notably sulphur hexafluoride at a suitable pressure. Bushings 12, 14 forming current-carrying terminals pass through the wall of the enclosure 10, one 14 of the bushings bearing a main stationary contact pad 16. The other bushing 12 is extended inside the enclosure 10 by a support 18 of a fixed articulation spindle 20 of a movable main contact in the form of a knife-blade 22, cooperating in the closed position with the stationary contact pad 16. The knife-blade 22 can be formed by two contact blades subjected to the action of a spring and clamping a contact pad 16 or on the other hand the knife-blade 22 may be a single blade which is inserted between contact grips forming the stationary contact pad 16. In the closed position of the switch, the stationary contact pad 16, knife-blade 22 and support 18 are appreciably aligned and form a main circuit for the current to flow from one of the bushings to the other. Parallel to this main circuit and laterally offset inside the enclosure 10 there is disposed an arcing circuit formed by coil 24, a cylindrical electrode 26, a movable arcing contact 28 and a support arm 30. The support arm 30 securedly united to the bushing 12 bears an articulation spindle 32 of the movable arcing contact 28 and the coil 24 is electrically connected to the opposite bushing 14. The movable arcing contact 28 comprises a contact stud 34 in the form of a cylindrical disk coming into contact in the closed position with the internal surface 36 of the cylindrical electrode 26. The articulation spindle 32 of the arcing contact is located on the axis 38 of the cylindrical electrode 26 and this spindle 32 extends parallel to the articulation spindle 20 of the knife-blade 22.

The movable arcing contact 28 is extended beyond the spindle 32 by an arm 40 on which a connecting rod 42 is articulated, the opposite end of which bears a trunnion 44 slidingly mounted in an aperture 46 arranged at the end of a crank 48 securedly united to the knife-blade 22. A spring 50 fitted between the articulation spindle 20 of the knife-blade 22 and the trunnion 44 urges the latter towards the bottom of the aperture 46 in the position where the spindle 20 moves away. In the closed position represented in FIG. 1, the trunnion 44 is in an intermediate compression position of the spring 50, the latter exerting via the connecting rod 42 and arm 40 a force pressing the contact stud 34 against the cylindrical surface 36.

A rotating operating shaft 52 passes tightly through the wall of the enclosure 10 and its outside end is connected to an operating mechanism which is not shown. The inside end of the operating shaft 52 bears a crank 54 connected by a spindle 56 to an operating rod 58, articulated at its opposite end 60 on the knife-blade 22. It can easily be seen that in the closed position, represented in FIG. 1, the toggle formed by the crank 54 and rod 58 is in an extension position holding the knife-blade 22 in the closed position and that a counter-clockwise rotation of the shaft 52 causes the knife-blade 22 to move to the open position by pivoting clockwise on the spindle 20. Closing of the switch is achieved by rotation of the operating shaft 52 in the opposite direction in a manner well-known to those specialized in the art.

Figure 3:
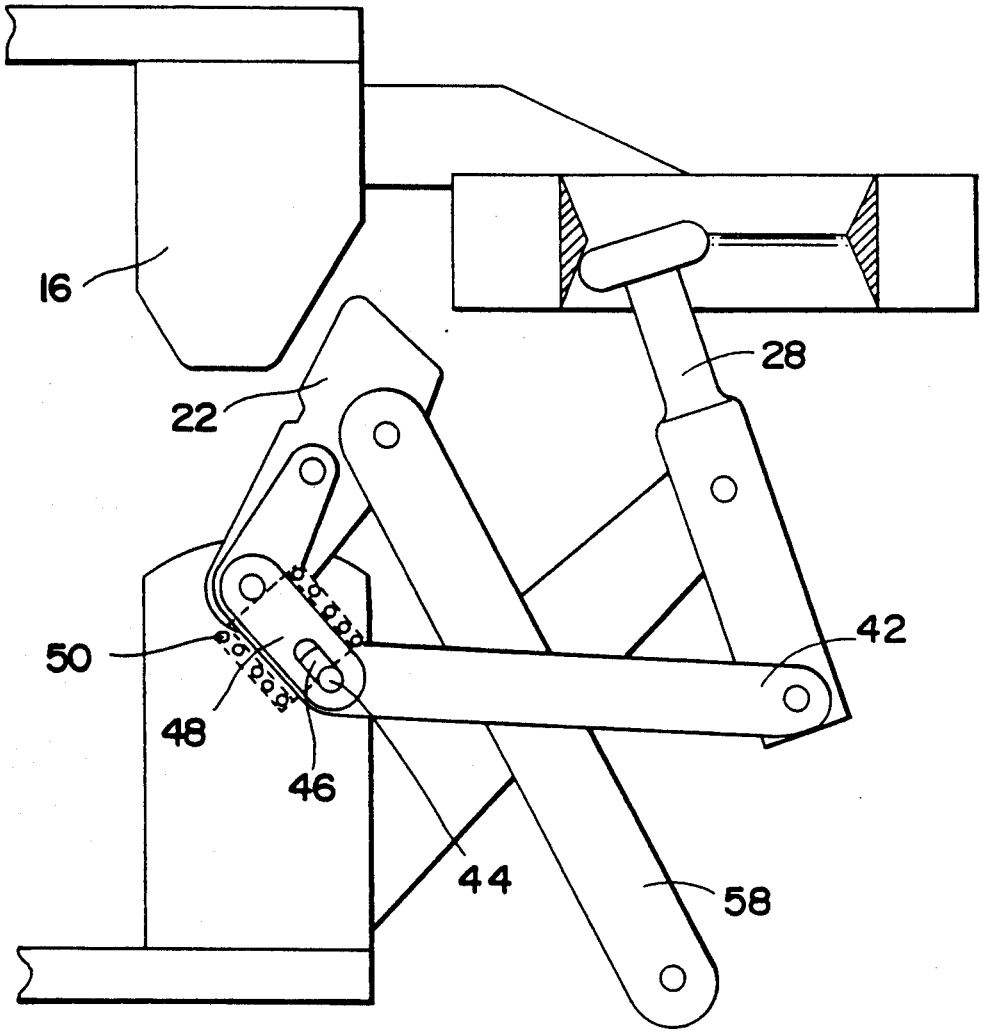
FIGS. 3 and 4 show partial views similar to that of FIG. 1 showing the switch respectively in the course of opening and in the open position.
Figure 4:
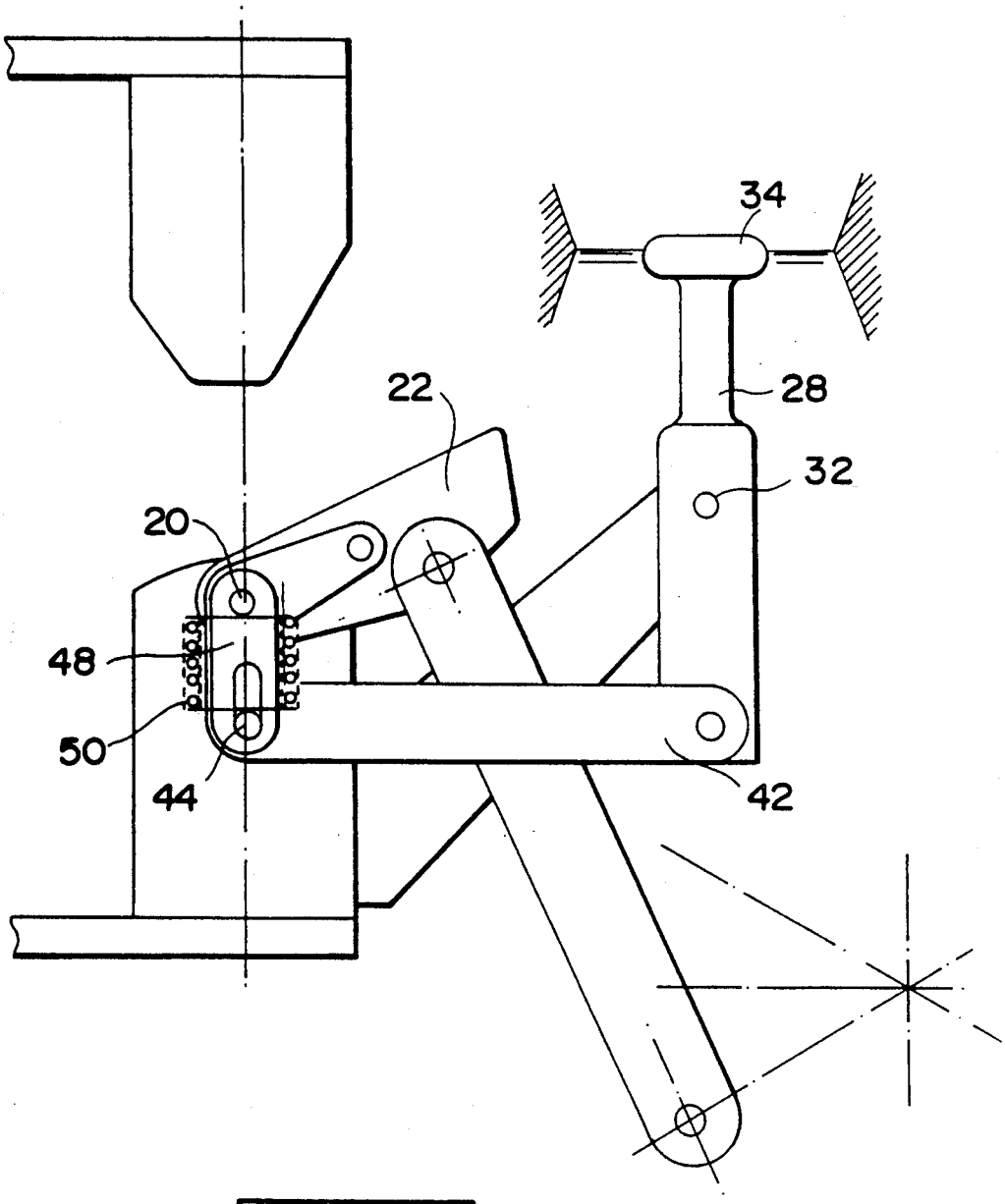

The switch according to the invention operates as follows:

In the closed position represented in FIG. 1, the main contacts 16, 22 and the arcing contacts 26, 34 are closed, almost all the current flowing in the main circuit of lower inductance formed by the main contacts 16, 22. The current flowing in the arcing circuit notably the coil 24 is extremely small. An opening operation is engaged by counterclockwise rotation of the operating shaft 52 causing clockwise pivoting of the knife-blade 22. The crank 48 accompanies the knife-blade 22 in its pivoting and in the first stage the spring 50 pushes the trunnion 44 towards the bottom of the aperture 46, the connecting rod 42 remaining in its initial position. After it has covered the dead travel constituted by the aperture 46, the trunnion 44 comes up against the bottom of the aperture (see FIG. 3) and continued pivoting of the crank 48 causes the trunnion 44 to be driven and the connecting rod 42 to be moved to the left in FIG. 3. This movement is transmitted to the arm 40 wich causes pivoting of the arcing contact 28 which in the final open position, represented in FIG. 4, comes into axial alignment with the cylindrical electrode 26. In this open position the connecting rod 42 is perpendicular to the crank 48 and the trunnion 44 is urged by the spring 50 to the bottom of the aperture 46. It can easily be seen that any attempt by the movable arcing contact 28 to pivot is transmitted to the connecting rod 42 which is held by the crank 48. The flexible link formed by the spring 50 is neutralized by the perpendicular connecting rod 42 and crank 48 position. The positions of the movable main contact 22 and of the movable arcing contact 34 are perfectly defined and the kinematic operating chain is capable of opposing the high repulsion forces exerted on the contacts.

Closing of the switch is brought about by rotation of the operating shaft 52 in the opposite direction causing clockwise pivoting of the crank 54 and counterclockwise pivoting of the knife-blade 22 due to the operating rod 58. The crank 48 pivots with the knife-blade 22 around the fixed spindle 20 and this movement is transmitted by the connecting rod 42 to the movable arcing contact 28 which pivots counterclockwise around the fixed spindle 32. After a preset travel the contact stud 34 comes up against the internal surface 36 of the annular electrode 26 which prevents continued movement of this contact 34. In this intermediate position, which corresponds to the one illustrated by FIG. 3, the main contacts 16, 22 are still separated and closing is achieved by the arcing circuit. The flexible link due to the aperture 46 and spring 50 allows continued pivoting of the knife-blade 22, the trunnion 44 sliding in the aperture 46 until the knife-blade 22 reaches the closed position represented in FIG. 1. It can be seen that the spring 50 provides the contact pressure of the arcing contacts 26, 34. The mechanism is particularly simple and ensures the synchronism and succession of opening and closing of the contacts necessary for protection of the main contacts 16, 22. This mechanism likewise provides the closing contact pressure and holds or locks the movable arcing contact 28 in the open position in the center of the cylindrical electrode 26. In this open position the arc drawn when the arcing contacts 26, 34 separate extends radially inside the cylindrical electrode 26 and is subjected to the axial magnetic field generated by the current flowing through the coil 24. The action of this field subjects the arc to a rotation favoring its extinction. The arrangement according to the invention of the arcing contacts 26, 34 parallel and with a lateral offset inside the enclosure 10 with respect to the main contacts 16, 22, enables the functions to be clearly separated and prevents any interference liable to cause restriking or flashovers on the main contacts 16, 22. The radial arrangement of the arc inside the cylindrical electrode 26 limits the risks of migration and the length of the arc can correspond to the optimum extinction length. The use of a disk-shaped arcing contact 34 provides a symmetry and shaping favorable to arc blow-out and interruption.

We claim:

1. An electrical gas-blast switch by arc rotation due to the action of a magnetic field, comprising:

a stationary main contact and a movable main contact, which can be moved between a closed position and an open position, a first fixed spindle on which said movable main contact is pivotally mounted, an operating mechanism to move said movable main contact from the closed position to the open position and vice-versa, a rotation electrode forming a stationary arcing contact and a movable arcing contact which can be moved between a closed position in which the movable arcing contact is in contact with the internal periphery of the electrode and an open position in which it is appreciably in the center of said electrode, a second fixed spindle parallel to the first spindle and on which the movable arcing contact is pivotally mounted, a coil coaxially disposed around said rotation electrode and electrically connected in series with said arcing contacts in a circuit parallel to said main contacts in such a way that the arcing current flows through the coil to generate the magnetic field blowing the arc out by rotation, a mechanical link connecting the movable main contact and the movable arcing contact to bring about opening of the arcing contacts after that of the main contacts and closing of the arcing contacts before that of the main contacts, a flexible part incorporated in said mechanical link to generate the closing contact pressure of the arcing contacts and to allow a continued closing movement of the movable main contact after the movable arcing contact has moved to the closed position and inversely a prior opening movement of the movable main contact before the movable arcing contact opens, a means of neutralizing said flexible part in the central open position of the movable arcing contact to create a rigid link between the two movable contacts in this open position, and a sealed enclosure, filled with a high dielectric strenght gas, in which said contacts and said coil are disposed.

2. The electrical switch according to claim 1, wherein said mechanical link comprises a drive crank and a connecting rod connected by an articulation to the crank which comprises said flexible part, and said crank extends perpendicular to the connecting rod in the open position.

3. The electrical switch according to claim 2, comprising a lengthwise aperture extending in the longitudinal direction at the end of the crank, a trunnion supported by the end of the connecting rod and slidingly mounted in said aperture and a spring to urge said trunnion to the bottom of the aperture at the end of the crank.

4. The electrical switch according to claim 3, wherein the drive crank is rigidly secured to the movable main contact to perform an angle of movement lower than or equal to 90° between the open position, in which the connecting rod and crank are appreciably perpendicular, and the closed position of the contacts in which the connecting rod and crank are close to the aligned position.

5. The electrical switch according to claim 4, wherein the end of the connecting rod opposite the crank is articulated on the movable arcing contact.

6. The electrical switch according to claim 1, wherein said second fixed spindle is disposed perpendicularly on the axis of said electrode and said movable arcing contact extends on the axis of the electrode in the open position.

7. The electrical switch according to claim 1, comprising a rotating operating shaft passing tightly through the wall of said enclosure and a transmission system by connecting rod and crank forming a mechanical link between the movable main contact and said rotating shaft to control opening and closing of the main contacts.

8. The electrical switch according to claim 1, comprising two bushings the ends of which inside the enclosure are arranged as current-carrying terminals disposed face to face, one of said terminals constituting the stationary main contact and the other terminal supporting said first fixed articulation spindle of the movable main contact, appreciably aligned with said terminals in the closed position.

9. The electrical switch according to claim 8, wherein said electrode is cylindrical and is arranged with the coil adjacent to and laterally offset from said stationary main contact, and a support of the second pivoting spindle of the movable arcing contact is securedly united to said other terminal and extends laterally in the direction of offset of said cylindrical electrode and coil.

10. The electrical switch according to claim 1, wherein the movable arcing contact is a disk-shaped contact stud operating in conjunction with the internal surface of the electrode and the movable main contact is a knife-blade operating in conjunction with stationary contact grips.

* * * * *